United States Patent [19]

Kunczynski

[11] Patent Number: 4,867,069

[45] Date of Patent: Sep. 19, 1989

[54] TRANSPORTATION SYSTEM DRIVE-SHOE ASSEMBLY AND METHOD

[75] Inventor: Jan K. Kunczynski, Glenbrook, Nev.

[73] Assignees: Zygmunt Alexander Kunczynski; Alexander Jan Kunczynski, both of Carson City, Nev.

[21] Appl. No.: 176,662

[22] Filed: Apr. 1, 1988

[51] Int. Cl.[4] ..... B61B 13/00

[52] U.S. Cl. ..... 104/168; 105/148

[58] Field of Search ..... 104/18, 27, 28, 29, 104/89, 91, 118, 119, 121, 165, 168; 105/148, 149, 150, 29.1

[56] References Cited

U.S. PATENT DOCUMENTS

| | | | |
|---|---|---|---|
| 3,759,188 | 9/1973 | Woods | 104/168 |
| 3,871,303 | 3/1975 | Woodling | 104/168 |
| 3,880,088 | 4/1975 | Grant | 104/168 |
| 4,671,186 | 6/1987 | Kunczynski | 104/168 |
| 4,744,306 | 5/1988 | Kunczynski | 104/168 |

*Primary Examiner*—Sherman D. Basinger
*Assistant Examiner*—Stephen P. Avila
*Attorney, Agent, or Firm*—Flehr, Hohbach, Test, Albritton & Herbert

[57] ABSTRACT

A drive-shoe assembly (30) and method for accelerating/decelerating a carrier unit (14) along a rail (12) or the like. The drive-shoe assembly (30) includes a rigid shoe segment (36) which frictionally engages the adjacent acceleration/deceleration drive wheels (22) operating at different speeds, and a movable segment (38) which supports the weight of the carrier unit (14) yet does not impart any significant velocity to the carrier unit (14). The movable segment (38) includes a plurality of roller elements (35) which are in rolling contact with higher or lower speed drive wheels adjacent to the drive wheels (22) controlling the carrier unit velocity so as to minimize drive wheel wear and insure smooth carrier unit acceleration.

10 Claims, 1 Drawing Sheet

TRANSPORTATION SYSTEM DRIVE-SHOE ASSEMBLY AND METHOD

TECHNICAL FIELD

In general the present invention relates to improvements in transportation systems employing movable carrier units that are propelled by a plurality of drive wheels, and, more particularly, relates to drive-shoe assemblies carried by such carrier units and a method for supporting and propelling such carrier units.

BACKGROUND OF THE INVENTION

Currently, certain transportation systems are based upon the use of passenger and freight carrier units which are propelled by drive wheels that frictionally engage a drive-shoe assembly mounted to the carrier units. In order to insure relatively positive control and frictional driving of the carrier units, such transportation systems typically support a substantial portion of the weight of each unit by engagement of the drive-shoe assembly with the drive wheels as the units pass along the guide track or rail. People mover systems having rail-supported cabins or cars, and aerial tramways with detachable chairs or gondolas, are both examples of transportation systems in which the carrier unit weight often is supported on the system's drive wheels as the units are advanced.

One example of a people mover system of this type is disclosed in my U.S. Pat. No. 4,671,186 entitled, "Positive Drive Assembly for Automatic, Rail-Based Transportation System." In such transportation systems the drive-shoe assemblies must be of a sufficient length to serve a two-fold purpose.

First, the drive-shoe assembly must always be in contact with at least one drive wheel so that the carrier unit, containing the people or cargo, may be accelerated up to speed from a stopped condition at any location along the support rail or track. Thus, the drive wheels must be able to propel the carrier unit from a stationary position, not only at predetermined stations so that people or cargo may enter or exit the carrier unit, but also at any location along the rail so that the system can be started again after a power failure or after an emergency stop.

Secondly, the drive-shoe assembly must be of a sufficient length to support a substantial portion of the weight of the carrier unit, especially when it is full. This second requirement has resulted in the use of drive-shoe assemblies which were so long that they were in contact with several drive wheels at the same time. This presented a problem to which the present invention is directed.

In the transportation system of my prior patent, U.S. Pat. No. 4,671,186, carrier units were accelerated up to speed (and decelerated) by operating adjacent drive wheels at different speeds and allowing at least one wheel to slip with respect to the drive-shoe as the units were accelerated. The first wheel encountered by the drive-shoe would essentially control the unit speed. When the drive-shoe engaged the next wheel, operating at a higher speed, the next wheel would initially slip with respect to the shoe and then accelerate the unit up to the speed of the high speed wheel, which would result in slipping of the slower moving first wheel with respect to the drive shoe.

It was discovered, however, that as the carrier unit weight and payload increased, the drive-shoe must engage more adjacent drive wheels in order to support the carrier load. In the acceleration/deceleration sections (not the sections of constant velocity) of the transportation system, the differing operating speeds of adjacent drive wheels was producing slipping over such a substantial length of the longer drive shoe that the drive wheels (rubber tires) were wearing out prematurely. Additionally, as the weight of the carrier unit increases and the drive shoe contacts more drive wheels, the change in speed (acceleration) of the carrier unit from one drive wheel to the next is somewhat less smooth. The high weight and corresponding high friction force on each drive wheel tends to cause fighting of the drive wheels to control speed before one of the wheels begins slipping.

Accordingly, it is an object of the present invention to provide a drive-shoe assembly and a method suitable for use in a transportation system which are capable of supporting a substantial carrier unit load while maintaining a smooth acceleration/deceleration of the carrier unit and while minimizing drive wheel wear.

Another object of the invention is to provide a drive-shoe assembly and method which reduce the amount of sliding frictional contact between the drive shoe assembly and adjacent drive wheels operating at different speeds.

It is also an object of the invention to provide a drive-shoe assembly and a transportation system which will support the weight of the movable carrier units while reducing drive wheel wear.

It is a further object of the invention to provide an apparatus and method, consistent with the foregoing objects, which is durable, easy to install and maintain and economical to manufacture.

SUMMARY OF THE INVENTION

The drive-shoe assembly of the present invention is suitable for use in a people mover system or the like having rail means, a load supporting carrier unit movably mounted to the rail means, and a plurality of drive wheels mounted proximate to the rail means and engaging the drive shoe assembly which is mounted to the carrier unit. The carrier unit is movably mounted to the rail means for support of a substantial portion of the weight of the carrier unit by engagement of the drive shoe assembly with the drive wheels as the carrier unit moves along the rail means.

The improvement in the drive-shoe assembly comprises, briefly, the drive shoe assembly including a rigid shoe segment frictionally engaging the drive wheels and having a length along the rail means sufficient for acceleration/deceleration of the carrier unit to produce movement of the carrier unit along said rail means; and the drive shoe assembly further having movable means, preferably rollers, which engage the drive wheels and have a length, in combination with said length of the rigid segment, sufficient to support the weight of the carrier unit applied against the drive wheels as the carrier unit is propelled down to the rail means. The rollers do not transmit any significant driving force from the drive wheels to the carrier unit, but they do support a substantial portion of the weight of the carrier unit.

In another aspect of the present invention, a method of supporting and propelling a carrier unit along rail means by a plurality of spaced apart drive wheels is provided. The method includes the steps of mounting said carrier unit for movement along the rail means, supporting a portion of the weight of said carrier unit by frictionally engaging a rigid drive shoe mounted on said carrier unit with said drive wheels as said carrier unit moves along said rail means, and propelling said carrier unit along said rail means by rotating said drive wheels.

The improvement in the method is comprised, briefly, of during the supporting step, engaging roller means carried by the carrier unit with the drive wheels to distribute the portion of the weight of the carrier unit between the rigid drive shoe and the roller means as the carrier unit moves along the rail means.

BEST MODE OF CARRYING OUT THE INVENTION

Figure 1:
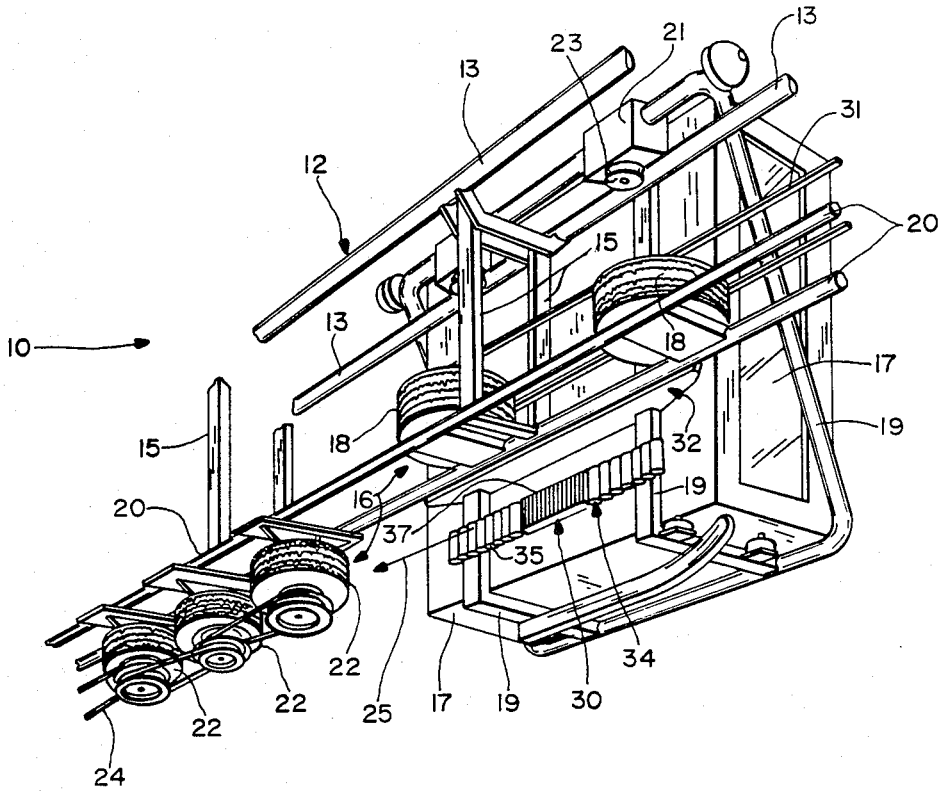
FIG. 1 is a bottom perspective view of an automatic, rail-based transportation system having a drive-shoe assembly constructed in accordance with the present invention.

Turning now to the drawings, attention is directed to FIG. 1 which illustrates a transportation system, generally designated 10, primarily comprised of three major components, namely, rail means 12, a carrier unit 14 and drive means 16. In its broad aspect, transportation system 10 essentially can be constructed as is more fully set forth in my U.S. Pat. No. 4,671,186. Accordingly, the major system components will only be described briefly herein, and the details of construction of the major components of the system of U.S. Pat. No. 4,671,186 are incorporated herein by reference.

In order to provide a track or guideway for transportation system 10, rail means 12 is preferably provided as a pair of top bars or pipes which act as rail members 13 and a pair of bottom bars or pipes 20 which are primarily structural support members. Top rails 13 and bottom bars 20 are supported in spaced relation by a box-like framework 15. Rail means 12 extends over the desired course and may be supported above the ground by posts or towers (not shown).

Movably mounted and cantilevered from a side of rail means 12 are carrier units 14, which preferably take the form of a cabin 17 mounted to framework 19. Side doors (not shown) in the outwardly facing side of cabin 17 may be opened and closed to permit the entry and exit of passengers and freight at system terminals. Rolling support of carrier unit 14 on top rails 13 is advantageously provided by roller assemblies 21, which include both vertically oriented sheaves (not shown) and horizontally oriented sheaves 23.

Cantilever mounting of carrier unit 14 from a side of top rail 13 of rail means 12 results in a substantial clockwise moment (as viewed in FIG. 1) around top rail 13, which moment tends to swing the carrier unit inwardly against bottom bar 20. This clockwise moment about top rail 13 is employed to effect driving of the carrier unit by drive means 16.

In order to provide both acceleration/deceleration and constant velocity, drive means 16 includes both acceleration/deceleration drive wheels 22 and constant velocity drive wheels 18. Both sets of drive wheels are advantageously mounted to rail means 12 and are positioned proximate to lower bars 20 so that the moment of the carrier unit about top rail 13 will urge the carrier unit against drive wheels 18 and 22.

In the preferred form illustrated in FIG. 1, rail means 12 and drive wheels 18 and 22 are relatively dimensioned so that the drive wheels extend outwardly beyond bottom bars 20 on both sides of rail means 12. Thus, drive wheels 18 and 22 may be used to drive carrier unit 14 in one direction, as indicated by arrow 25, on one side of rail means 12, and in an opposite direction on the other side of rail means 12. Moreover, the drive wheels engage and support a substantial portion of the weight of the carrier units as they pass along the rail means, with the frictional engagement between the drive wheels and carrier units being employed to effect propulsion of the carrier units. Most preferably, drive wheels 18 and 22 are rubber tires, for example, pneumatic automobile tires, and carrier unit 14 has a drive-shoe assembly, generally designated 30, mounted to an inwardly facing side of the carrier unit. The coefficient of friction between the rubber tires and drive-shoe 30 can be substantial, permitting the present system to be used to drive carrier units even up inclined rails.

One advantage of the cantilevered mounting of the carrier units is that, as the weight of the load increases, the moment and friction force between the carrier unit drive-shoe and the drive wheels also increases. Thus, increasing carrier unit weight does not result in slipping of the drive wheels or an inability to drive carrier units having increased weight.

One disadvantage of the cantilever mounting system, however, is that increasing weight loads the drive wheels to a greater degree, which produces undesirable effects in the acceleration/deceleration portions of the system.

The economics of transportation systems generally dictate that it is advantageous to separate drive wheels by the maximum distance reasonably possible to reduce the number of drive wheels which are required. Thus, constant velocity drive wheels 18 are separated by a distance about equal to, but slightly less than, the length of carrier unit cabin 17. Drive shoe assembly 30 can extend along the length of cabin 17 but should be slightly longer than the spacing between wheels 18. All of the drive wheels 18 operate at the same velocity and carrier unit 14 similarly travels down rail means 12 in the sections which have drive wheels 18 at the same velocity as drive wheels 18.

As shown in the drawing, belts 31, mounted to sheaves (not shown) of the same diameter, are used to transmit driving forces to wheels 18 from a prime mover (not shown). More recently, it has been found advantageous to drive drive wheels 18 and 22 through drive shafts and reduction gear box assemblies, but however driven, all of wheels 18 operated at the same speed.

It should be noted, however that in the event that the system drive motors or prime movers are shut down, for example, in an emergency or upon a power failure, wheels 18 can gradually be brought up to speed to accelerate carrier units 14 up to the desired constant velocity speed. This start-up acceleration (or shut-down deceleration) however, is accomplished at the controller for the prime mover. Thus, at any given time all of wheels 18 are moving at the same velocity, with the velocity being increased (or decreased) together. In the areas of constant velocity drive wheels 18, therefore, there is little or no relative slipping between the drive wheels and the drive-shoe.

By contrast, however, acceleration/deceleration drive wheels 22 effect acceleration/deceleration of carrier unit 14 by a planned relative slipping of at least some of these drive wheels with respect to drive-shoe assembly 30.

Adjacent drive wheels 22 simultaneously operate at different speeds. Thus, if the first drive wheel 22 operates at velocity V, the next adjacent drive wheel 22 will operate at 1.1V. The difference in velocity between adjacent drive wheels 22 is preferably about 1.1 times the previous wheel's velocity, but it may be as high as 1.3. Drive-shoe assembly 30 must be long enough to simultaneously contact at least two adjacent drive wheels so that the carrier units can be accelerated to speed from a stopped or zero velocity condition when the carrier units are located anywhere along acceleration section of the transportation system.

In the acceleration/deceleration sections, the drive shoe will first engage and be driven by one drive wheel 22, and as the drive shoe advances into contact with a second, higher speed drive wheel 22, the second wheel will initially slip with respect to drive-shoe assembly 30 until the velocity of the carrier unit (and drive shoe) is increased to the velocity of the second wheel. As the carrier unit velocity increases to the velocity of the second drive wheel 22, the first, slower drive wheel 22 will begin to slip with respect to drive shoe 30. This process is repeated as the carrier unit is advanced and the drive shoe engages subsequent drive wheels 22. Similarly, the slipping process occurs and is reversed during deceleration of the carrier units.

In acceleration/deceleration sections of the rail system it is desirable to effect acceleration/deceleration over a reasonably short length of the rail. If each tire 22 increases the carrier speed by 10%, V to 1.1V, the spacing of drive wheels 22 usually will be much less than the spacing of the wheels 18 in the constant velocity sections in order to reach the constant velocity speed over a relatively short rail length.

The adverse effect of increasing carrier unit weight on a transportation system employing drive wheel slippage as a basis for acceleration/deceleration can now be described. As the weight of the carrier units increases, it becomes necessary to support that weight by simultaneously engaging drive-shoe assembly 30 with more drive wheels to reduce the unit load. This can be accomplished by increasing the drive shoe length and/or decreasing the drive wheel spacing. As above-noted, drive wheel spacing in the acceleration/deceleration sections is close in any event (usually only a few inches separation) and further reduction in wheel spacing is not practical. Increasing the shoe-assembly length in acceleration/deceleration sections which have closely spaced drive wheels, however, increases the need for and length of slipping of the drive wheels with respect to the shoe-assembly, since the carrier unit is operating at the speed of only one of the drive wheels 22.

It has been found, therefore, that for relatively heavily loaded carrier units 14, for example, units capable of carrying 10 to 20 passengers, lengthening drive-shoe assembly 30 to accommodate the carrier load results in undesirable wear of tires 22 and a tendency of the different velocity tires to induce jerky or uneven acceleration. The increased carrier weight results in higher friction force and a less reproducible transition between static and sliding friction. Thus, adjacent drive wheels fight each other more for control of carrier unit speed, with attendant uneven acceleration.

Accordingly, in transmission system 10 of the present invention, a new drive-shoe assembly 30 has been devised which minimizes drive wheel wear and which enhances the smooth acceleration/deceleration of the carrier units.

Figure 2:
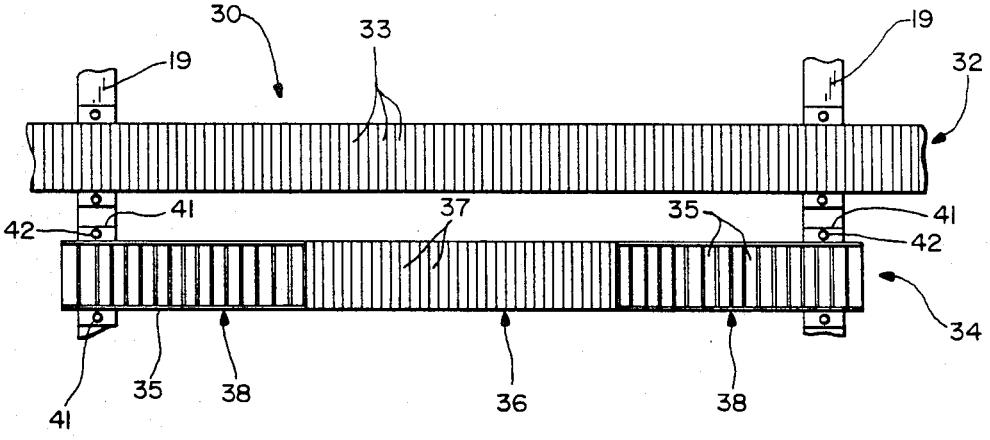
FIG. 2 is a fragmentary, enlarged, side view of the drive-shoe assembly of FIG. 1.

The drive-shoe assembly 30, best seen in FIG. 2, has two separate drive shoes, which construction also was used in the system of my U.S. Pat. No. 4,671,186. The upper shoe 32 is positioned to contact drive wheels 18, and lower shoe 34 is positioned to engage acceleration/deceleration drive wheels 22. Upper shoe 22 may be formed as a rigid member over its entire length. Expanded metal grids or a structure with vertical ribs 33 may be used advantageously to increase the coefficient of friction with rubber tires 18. Since there is no substantial slippage between tires 18 and shoe 32, simultaneous contact of shoe 32 with more than one tire is not a problem.

The improvement in shoe assembly 30 is contained in lower shoe 34. Shoe 34 includes a rigid drive-shoe segment 36, here shown centrally disposed, surrounded by two rotatable or movable drive-shoe segments 38. Rigid segment 36 is relatively short and provides a surface with ribs 37 which engages with drive wheels 22 to accelerate/decelerate the carrier unit. The length of rigid segment 36 is only slightly greater than the spacing between acceleration/deceleration drive wheels 22. Rotatable segments 38 of shoe 34 provide a support surface for contact of the carrier unit by additional drive wheels 22 without imparting any substantial driving force to carrier unit 14. Movable segments 38 are preferably provided by a plurality of roller elements 35. Frictional engagement of these rollers by drive wheels 22 imparts substantially no driving force to the carrier unit, but rollers 35 do support the weight of the carrier unit on the drive wheels. The rolling contact between drive wheels 22 and rollers 38 does not subject the tires to the high wear produced by slipping the tires on a rigid drive shoe.

Carrier unit acceleration/deceleration is still accomplished by drive wheels 22 which includes slipping one drive wheel while the other drive wheel controls carrier velocity, but now rigid section or segment 36 is only slightly greater in length than the greatest distance between the adjacent wheels 22. Thus, slipping between the higher speed drive wheel occurs over a very short distance, until the rigid shoe segment 36 leaves the lower speed drive wheel and the unit reach the higher speed drive wheel velocity. During this process, however, the roller segments 38 are supporting the weight of the carrier unit on drive wheels 22 on both sides of the drive wheel controlling unit velocity.

As was the case in the transportation system of my prior U.S. Pat. No. 4,671,186, certain of drive wheels 18 or 22 may have teeth or protrusions to produce positive engagement with ridges 33 of drive shoe 32 or ridges 37 of drive-shoe segment 36. As also was true of my prior transportation system, when toothed drive wheels are employed, the toothed drive wheels are positioned at every other location along rail means 12. Roller elements 35 in drive shoe 34 are preferably of a diameter (large enough) and spacing which produces rolling contact between even toothed drive wheels and segments 38, rather than mating or interlocking of the drive wheel teeth with rollers 35.

Drive-shoe 34 is mounted by mounting means such as brackets 41 that are welded or fastened by fasteners 42 to carrier unit frame members 19 for sequential engagement of the drive-shoe by drive wheels 22 in the acceleration/deceleration sections of the system.

The exact length dimension in a direction along rail means 12 of the rigid segment 36 of lower drive shoe 34 is not critical, as long as it is always in contact with at least one drive wheel 22 and is not in contact with two drive wheels over a substantial distance. Moreover, rigid segment 36 need not be centrally disposed on shoe 34. Rather, segment 36 could be located at one end or the other of lower drive shoe 34, since it would still provide the necessary propulsion and the movable or rolling segment 38 will provide the necessary support. Similarly, the exact length of rotatable segment 38 is not critical, as long as it is of a sufficient length to support the maximum weight of loaded carrier unit 14.

The method of supporting and propelling carrier unit 14 along rail means 12 of the present invention includes the steps of mounting the carrier unit to rail means 12 for movement therealong, for example by rolling support of the carrier unit on top rail 13. Additionally, the method of the present invention includes supporting a portion of the weight of the carrier unit by frictionally engaging rigid drive shoe 36 mounted on the carrier unit with drive wheels 22 as the carrier unit moves along the rail. Finally, the present method includes propelling carrier unit along rail means 12 by rotating drive wheels 22. Such method steps are broadly known in transportation systems.

The improvement in the present method, however, is comprised of engaging roller means 38 carried by unit 14 with drive wheels 22 during the supporting step to distribute the portion of the weight supported by the drive shoe assembly 30 between rigid drive shoe 36 and movable or rotatable drive-shoe segment 38.

What is claimed is:

1. An acceleration/deceleration drive-shoe assembly for a wheel powered, people mover system or the like, said people mover system having rail means, a load supporting carrier unit movably mounted to said rail means and having said drive shoe assembly carried thereby and extending in a direction along said rail means, and drive means associated with said rail means and including a plurality of drive wheels mounted proximate to said rail means and engaging said drive shoe assembly and propelling said carrier unit along said rail means, said carrier unit being further mounted to said rail means for support of a substantial portion of the weight of said carrier unit by engagement of said drive shoe assembly with said drive wheels as said carrier unit moves along said rail means, wherein the improvement in said drive-shoe assembly comprises:

said drive shoe assembly including a rigid segment frictionally engaging said drive wheels and having a length along said rail means sufficient for acceleration/deceleration of said carrier unit to produce movement of said carrier unit along said rail means; and said drive shoe assembly further having movable means engaging said drive wheels, said movable means having a length along said rail means, in combination with said length of said rigid segment, sufficient to support said portion of the weight of the carrier unit against said drive wheels as said carrier unit is propelled down to said rail means.

2. The acceleration/deceleration drive-shoe assembly as defined in claim 1 wherein, said movable means includes roller means rotatably mounted to said drive shoe assembly, said roller means transmitting substantially no driving force from said drive wheels to said carrier unit.

3. The acceleration/deceleration drive-shoe assembly as defined in claim 2 wherein, said roller means includes a plurality of roller elements positioned in two spaced apart roller segments; and said rigid segment of said drive-shoe assembly is centrally disposed between said roller segments.

4. The acceleration/deceleration drive-shoe assembly as defined in claim 1 wherein, said drive shoe assembly has a length equal to said carrier unit.

5. The acceleration/deceleration drive-shoe assembly as defined in claim 1 wherein, said rigid segment of said drive shoe assembly is sufficiently longer than the distance between the centers of the two adjacent drive wheels in said people mover system which are the greatest distance apart so that said carrier unit may be accelerated from a stationary position at any position along said people mover system.

6. A people mover system or the like, including:

rail means;

a load supporting carrier unit mounted to said rail means, said carrier unit having a drive-shoe assembly carried thereby and extending in a direction along said rail means;

a plurality of drive wheels mounted proximate to said rail means to engage said drive shoe assembly, support a portion of the weight of said carrier unit, and propel said carrier unit along said rail means; and said drive-shoe assembly further having a rigid section and a rotatable section extending in a direction along said rail means and engaging said drive wheel to support said portion of the weight of said carrier unit and frictionally drive said carrier unit.

7. A drive-shoe assembly for a carrier unit propelled along a guideway by a plurality of drive wheels, said drive shoe assembly comprising:

a rigid drive-shoe segment frictionally engaged by said drive wheels to propel said carrier unit, a roller drive-shoe segment proximate said rigid drive-shoe segment and rotatably engaging said drive wheels, and mounting means for mounting said rigid drive-shoe segment and said roller drive-shoe segment to said carrier unit.

8. A drive-shoe assembly as defined in claim 1 wherein, said rigid drive-shoe segment and said roller drive-shoe segment are both elongated and aligned with each other for sequential engagement thereof by adjacent ones of said drive wheels.

9. A method of supporting and propelling a carrier unit along rail means by a plurality of spaced apart drive wheels including the steps of, mounting said carrier unit for movement of said carrier unit along said rail means, supporting a portion of the weight of said carrier unit by frictionally engaging a rigid drive shoe mounted on said carrier unit with said drive wheels as said carrier unit moves along said rail means, and propelling said carrier unit along said rail means by rotating said drive wheels, wherein the improvement in said method comprises:

during said supporting step, engaging roller means carried by said carrier unit and extending in a direction along said rail means with said drive wheels to distribute said portion of the weight of said carrier unit between said rigid drive shoe and said roller means as said carrier unit moves along said rail means.

10. The method as defined in claim 9 wherein, said mounting step is accomplished by cantilever mounting said carrier unit to said rail means by rotatably mounted members for support of at least some of the weight of said carrier unit by said rail means, and said supporting step is accomplished by engaging said drive wheels with a drive-shoe assembly including both said rigid drive shoe and said roller means, said drive-shoe assembly having an overall length along said rail means sufficient to support said additional portion of the weight of said carrier unit and said rigid drive shoe having a length along said rail means sufficient to accelerate said carrier unit from stopped condition to a moving condition at any location along said rail means.

* * * * *